US009713405B2

(12) United States Patent
Cottman, Jr.

(10) Patent No.: US 9,713,405 B2
(45) Date of Patent: Jul. 25, 2017

(54) URINE WIPE SYSTEM

(71) Applicant: Eugene Cottman, Jr., Summerville, SC (US)

(72) Inventor: Eugene Cottman, Jr., Summerville, SC (US)

( * ) Notice: Subject to any disclaimer, the term of this patent is extended or adjusted under 35 U.S.C. 154(b) by 0 days.

(21) Appl. No.: 14/851,604

(22) Filed: Sep. 11, 2015

(65) Prior Publication Data

US 2017/0071420 A1 Mar. 16, 2017

(51) Int. Cl.

*A47K 11/00* (2006.01)
*A47K 10/38* (2006.01)
*E03D 13/00* (2006.01)

(52) U.S. Cl.

CPC ..... *A47K 10/38* (2013.01); *E03D 13/005* (2013.01)

(58) Field of Classification Search

CPC ..... A61G 9/006
USPC ..... 4/144.1–144.4
See application file for complete search history.

(56) References Cited

U.S. PATENT DOCUMENTS 2,566,770 A * 9/1951 Knitel ..... E03D 13/00 4/310
3,549,226 A * 12/1970 Samson ..... A47K 10/426 206/451
4,557,426 A * 12/1985 Siciliano ..... A47K 10/3836 225/34
D341,738 S * 11/1993 Balanesi ..... A47K 10/3836 D3/226
5,470,138 A * 11/1995 Kump ..... A47F 1/12 206/39.5
5,579,915 A * 12/1996 Liss ..... A47G 29/00 206/554
D522,290 S 6/2006 Ferderer
8,500,708 B2 * 8/2013 Glenn ..... A61G 9/006 4/144.1
8,690,846 B2 * 4/2014 Chen ..... A61F 5/451 4/144.1
2009/0151103 A1 * 6/2009 Gallu ..... A47K 10/42 15/209.1
2009/0199329 A1 * 8/2009 Thorne, Jr. ..... A47K 10/42 4/144.1
2009/0223993 A1 * 9/2009 Lorenzati ..... A47K 10/42 221/35
2012/0087972 A1 * 4/2012 Ballard ..... A61F 13/36 424/443

FOREIGN PATENT DOCUMENTS

EP 1508647 12/2003

* cited by examiner

*Primary Examiner* — Lori Baker

(57) ABSTRACT

A urine wipe system includes a urinal is mounted on a wall. A housing has a rear wall, a front wall and a perimeter wall that is attached to and extends between the front and rear walls. The rear wall is mounted on the wall within 3.0 feet of the urinal. The housing has an opening therein. A roll of wiping material is positioned within the housing and is rotatably mounted on a spindle. The wiping material extends through the opening and is comprised of a paper material that is biodegradable in water. The paper material is formed into a strip has a diameter of less than 2.0 inches.

2 Claims, 3 Drawing Sheets

URINE WIPE SYSTEM

BACKGROUND OF THE DISCLOSURE

Field of the Disclosure

The disclosure relates to penis wipe devices and more particularly pertains to a new penis wipe device for drying the end of a penis after urination to prevent soiling of underwear.

SUMMARY OF THE DISCLOSURE

An embodiment of the disclosure meets the needs presented above by generally comprising a urinal is mounted on a wall. A housing has a rear wall, a front wall and a perimeter wall that is attached to and extends between the front and rear walls. The rear wall is mounted on the wall within 3.0 feet of the urinal. The housing has an opening therein. A roll of wiping material is positioned within the housing and is rotatably mounted on a spindle. The wiping material extends through the opening and is comprised of a paper material that is biodegradable in water. The paper material is formed into a strip has a diameter of less than 2.0 inches.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
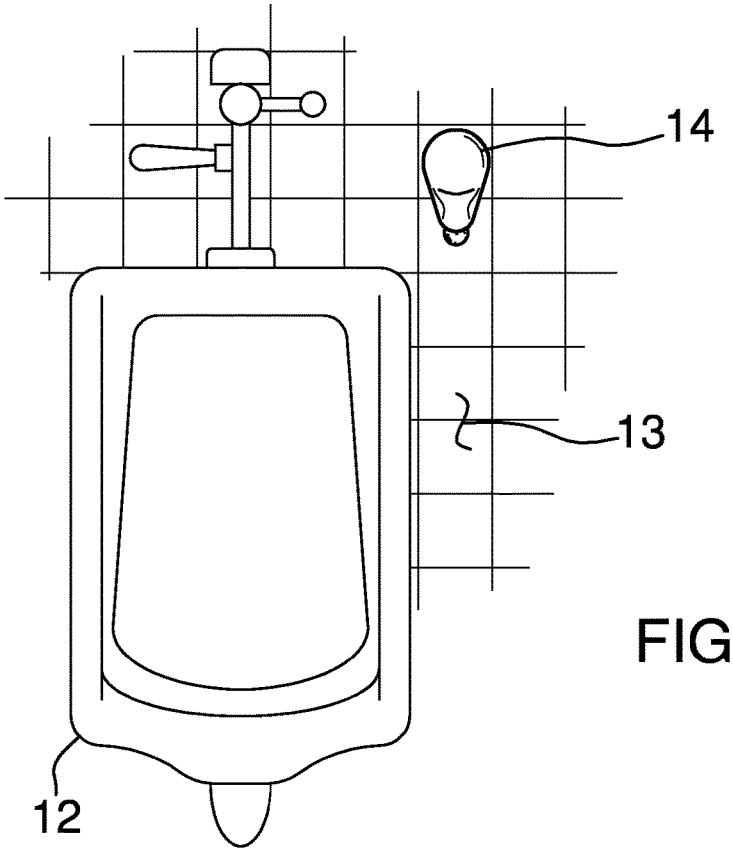
FIG. 1 is a front view of a urine wipe system according to an embodiment of the disclosure.
Figure 2:
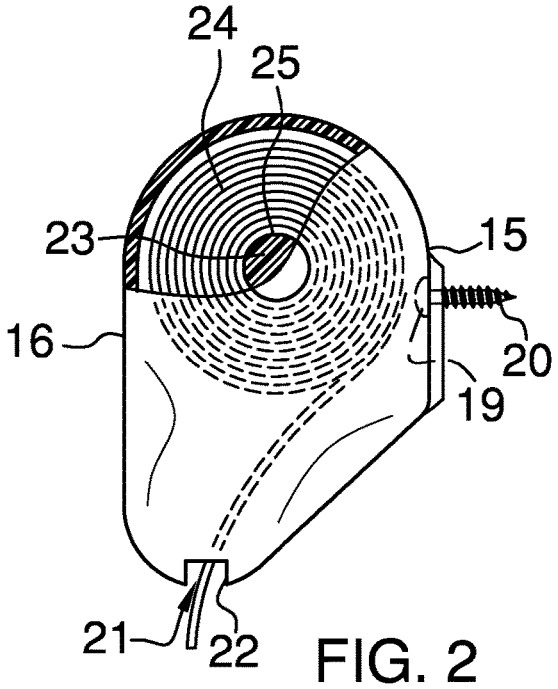
FIG. 2 is a broken side view of a housing of an embodiment of the disclosure.
Figure 3:
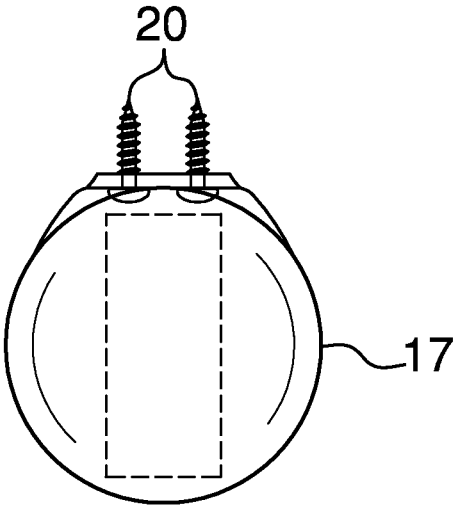
FIG. 3 is a top view of an embodiment of the disclosure.
Figure 4:
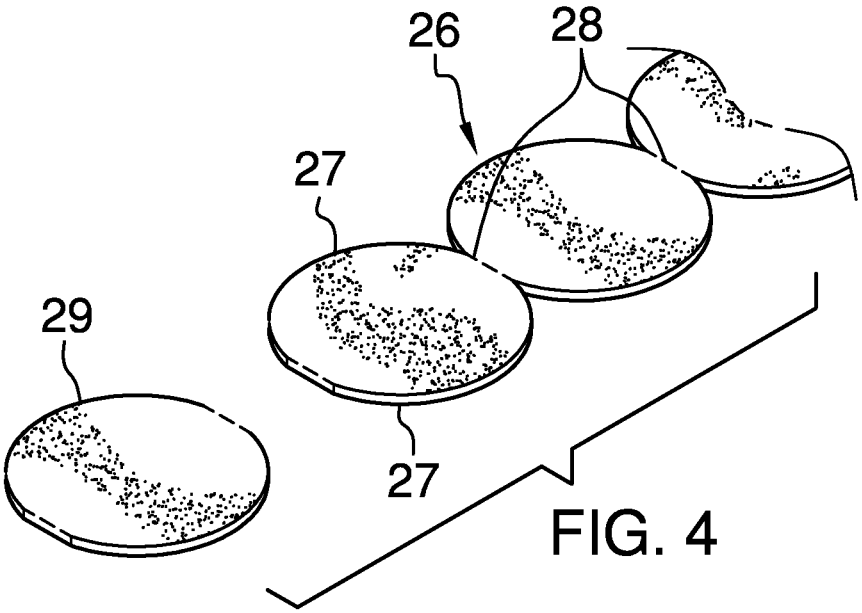
FIG. 4 is a perspective view of paper sheets of an embodiment of the disclosure.

With reference now to the drawings, and in particular to FIGS. 1 through 5 thereof, a new penis wipe device embodying the principles and concepts of an embodiment of the disclosure and generally designated by the reference numeral 10 will be described.

As best illustrated in FIGS. 1 through 5, the urine wipe system 10 generally comprises a urinal 12 that is mounted on a wall 13 such as within a public bathroom. The urinal 12 may comprise any conventional urinal and is configured for receiving urine alone as opposed to a toilet which is designed to also accept feces.

Figure 5:
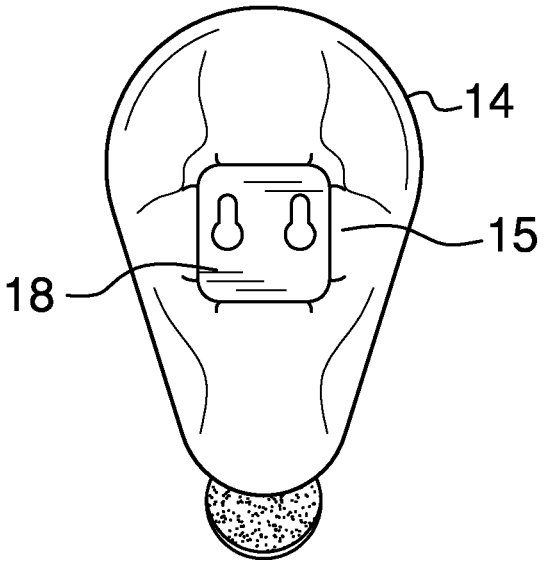
FIG. 5 is a rear view of the housing of an embodiment of the disclosure.

A housing 14 is provided which has a rear wall 15, a front wall 16 and a perimeter wall 17 that attached to and extends therebetween. The rear wall 15 is mounted on the wall 13 within 3.0 feet of the urinal 12. As can be seen in FIG. 5, the rear wall 15 may include a bracket 18 for receiving the head 19 of one or more threaded fasteners 20 which will be extended into the wall 13. Alternate mounting devices may be employed such as adhesives. The housing 14 has an opening 21 therein. The opening 21 is in a bottom wall 22 of the perimeter wall 17. The housing 14 may comprise a closed unit which is not readily openable or may include a door for accessing an interior of the housing 14.

A roll 24 of wiping material positioned within the housing 14 and is rotatably mounted on a spindle 23 in the housing 14. The roll 14 may be positioned on a sleeve 25 such as typically accomplished with conventional toilet paper. However, the roll 24 of wiping material may also be positioned within the housing 14 without being mounted on a spindle 23. The wiping material extends through the opening 21 and outwardly of the housing 14. The wiping material is comprised of a paper material that is biodegradable in water and which may be particularly well suited to dissolving in water since it will be discarded within a urinal as opposed to a toilet. The paper material is formed into an elongated strip 26 having a diameter is less than 2.0 inches and which may be equal to or less than 1.5 inches. The strip 26 has a pair of lateral edges 27. The strip 26 has a plurality of perforation lines 28 therein that extend between the lateral edges 27 and divide the strip into a plurality of sheets 29. The sheets 29 are tearable from each other along the perforation lines 28. Each of the lateral edges 27 of each of the sheets 29 is convexly arcuate such that each sheet has a generally annular shape to conform better to the head of a penis.

In use, a user of the system 10 will utilize the urinal 12 in a conventional manner. When the user is done urinating, they may tear off one sheet 26 and use this for drying the end of their penis to prevent urine from wetting the user's underwear. The sheet 29 may thereafter be discarded into the urinal 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A urine wipe system for facilitating wiping of urine off of a tip of a penis, said system comprising:

a urinal being mounted on a wall;

a housing having a rear wall, a front wall and a perimeter wall being attached to and extending therebetween, said rear wall being mounted on said wall within 3.0 feet of said urinal, said housing having an opening therein;

a roll of wiping material being positioned within said housing and being rotatably mounted on a spindle, said wiping material extending through said opening, said wiping material being comprised of a paper material being biodegradable in water, said paper material being formed into a strip having a diameter being less than 2.0 inches, wherein said strip has a pair of lateral edges, said strip having a plurality of perforation lines therein extending between said lateral edges, said perforations dividing said strip into a plurality of sheets, said sheets being tearable from each other along said perforation lines, wherein each of said lateral edges of each of said sheets is convexly arcuate.

2. A urine wipe system for facilitating wiping of urine off of a tip of a penis, said system comprising:

a urinal being mounted on a wall;

a housing having a rear wall, a front wall and a perimeter wall being attached to and extending therebetween, said rear wall being mounted on said wall within 3.0 feet of said urinal, said housing having an opening therein, said opening being in a bottom wall of said perimeter wall a roll of wiping material being positioned within said housing and being rotatably mounted on a spindle, said wiping material extending through said opening, said wiping material being comprised of a paper material being biodegradable in water, said paper material being formed into a strip having a diameter being less than 2.0 inches, said strip having a pair of lateral edges, said strip having a plurality of perforation lines therein, said perforations dividing said strip into a plurality of sheets, said sheets being tearable from each other along said perforation lines, each of said lateral edges of each of said sheets being convexly arcuate.

* * * * *